United States Patent [19]

Knapp et al.

[11] 4,300,506

[45] Nov. 17, 1981

[54] FUEL SUPPLY SYSTEM

[75] Inventors: Heinrich Knapp, Leonberg; Wolfgang Rehmann, Asperg, both of Fed. Rep. of Germany

[73] Assignee: Robert Bosch GmbH, Stuttgart, Fed. Rep. of Germany

[21] Appl. No.: 59,362

[22] Filed: Jul. 20, 1979

[30] Foreign Application Priority Data

Aug. 18, 1978 [DE] Fed. Rep. of Germany ..... 2836215

[51] Int. Cl.[3] ..... F02M 9/08

[52] U.S. Cl. ..... 123/478; 123/319; 123/337; 123/376; 123/318; 123/389; 123/391; 123/311; 261/65

[58] Field of Search ..... 123/478, 319, 337, 376, 123/318, 389, 391, 311; 261/65

[56] References Cited

U.S. PATENT DOCUMENTS

| | | | |
|---|---|---|---|
| 1,395,932 | 11/1921 | Staude | 261/65 |
| 1,826,202 | 10/1931 | Cole | 261/65 |
| 1,999,334 | 4/1935 | Mallory | 261/65 |
| 2,095,746 | 10/1937 | Jacobs | 123/378 |
| 2,252,416 | 8/1941 | Schwarz | 261/65 |
| 2,315,912 | 4/1943 | Udale | 123/389 |
| 2,740,391 | 4/1956 | Busch | 123/337 |
| 3,776,208 | 12/1973 | Stumpp | 123/478 |
| 3,920,778 | 11/1975 | De Rugeris | 261/65 |
| 3,949,714 | 4/1976 | Mitchell | 123/478 |
| 3,960,120 | 6/1976 | Aono et al. | 123/478 |

FOREIGN PATENT DOCUMENTS

| | | | |
|---|---|---|---|
| 633472 | 8/1929 | France | 123/311 |

*Primary Examiner*—Charles J. Myhre
*Assistant Examiner*—R. A. Nelli
*Attorney, Agent, or Firm*—Edwin E. Greigg

[57] ABSTRACT

A fuel supply system for supplying fuel and for satisfactorily preparing the fuel-air mixture fed to a mixture-compressing, spark-ignited internal combustion engine which comprises an arbitrarily operable throttle element arranged in the air intake manifold wherein fuel can be supplied upstream of this throttle element. The throttle element is mounted on a rocking lever connected to a bearing shaft arranged outside of the air flow at the air intake manifold and is displaceable in the opening direction during full load and at higher speeds against the force of a compensating spring until the throttle element comes into contact, with a full-load stop, with the rocking lever. During full load and at low speeds, the compensating spring displaces the throttle element in the closing direction so that a rather large pressure drop occurs at the throttle element so that an improved conditioning of the injected fuel is obtained. A resilient member, engaging via a compensating lever on the bearing shaft, serves to compensate for the opening moment effective at the throttle element due to the air pressure drop. The resilient member is under the effect, on the one hand, of the air pressure in the air intake manifold section downstream of the throttle element and, on the other hand, of the atmospheric pressure or the air pressure upstream of the throttle element with a resetting spring effective on the throttle element.

3 Claims, 1 Drawing Figure

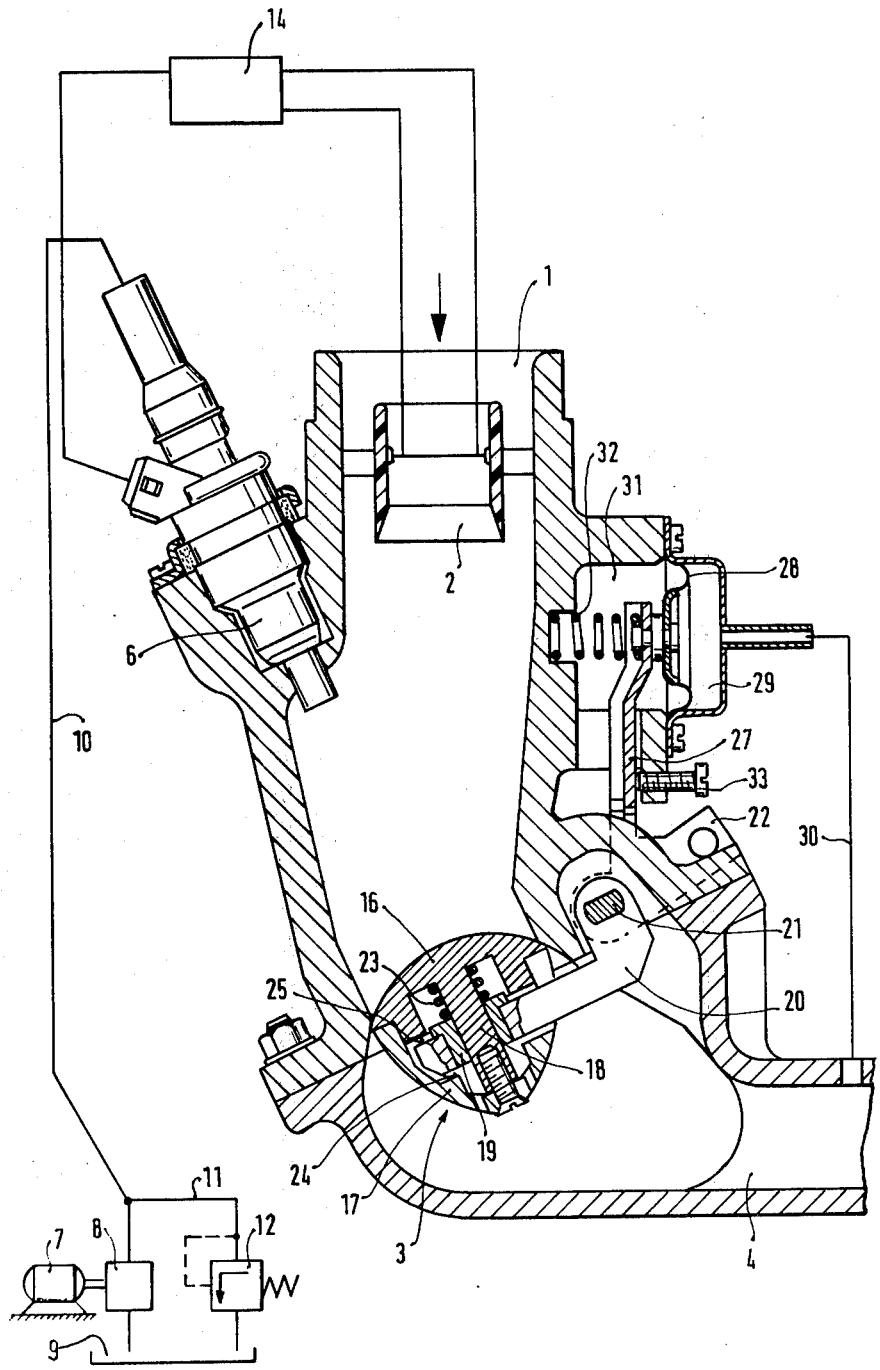
14
1
2
32
31
28
29
27
33
22
30
21
20
6
10
16
23
25
18
19
24
17
3
4
11
12
7
8
9

FUEL SUPPLY SYSTEM

BACKGROUND OF THE INVENTION

The invention relates to a fuel supply system. Such fuel supply systems, in general, are well-known but require a relatively high expenditure for structural parts for accomplishing their purpose.

OBJECT AND SUMMARY OF THE INVENTION

The fuel supply system of this invention has the advantage over prior art systems in that, with a minimum of structural parts, a very satisfactory conditioning of the fuel-air mixture is assured in all operating ranges.

BRIEF DESCRIPTION OF THE DRAWING

The single FIGURE of the drawing is a sectional view of the preferred embodiment of the invention.

DESCRIPTION OF THE PREFERRED EMBODIMENT

In the fuel supply system for a mixture-compressing, spark-ignited internal combustion engine, shown by way of example in the single FIGURE of the drawing, the taken-in combustion air flows downstream of an air filter (not shown) in the direction of the arrow into a section 1 of an air intake manifold having an air metering member. The air metering member is formed, for example, as a hot-wire air flowmeter (volumeter) 2 and the air intake manifold includes a throttle element 3. The combustion air flows via a section 4 of the air intake manifold to the individual cylinders (not shown) of the internal combustion engine.

Upstream of the throttle element 3 at least one fuel injection valve 6, activated, for example, electromagnetically, terminates in the air intake manifold section 1. An amount of fuel corresponding to the taken-in amount of air is injected by this injection valve 6 into the air intake manifold. The fuel injection valve 6 is arranged, if at all possible, so that the fuel cone exiting from the fuel injection valve 6 is oriented toward the air gap of the air intake manifold opened by the throttle element 3. The fuel supply to the fuel injection valve 6 is effected, for example, by a fuel pump 8 driven by an electric motor 7, this pump taking in fuel from a fuel tank 9 and conveying the fuel via a fuel line 10 to the fuel injection valve 6. A line 11 branches off from the fuel feed line 10 and a pressure control valve 12 is arranged in this line 11 through which fuel can flow back to the fuel tank 9.

The electromagnetically operable fuel injection valve 6 is conventionally controlled via an electronic control unit 14 in dependence on the amount of air taken in, determined, for example, by the hot-wire air flowmeter 2. In order to correct the amount of fuel injected, it is possible to feed to the electronic control unit 14 additional measuring signals characterizing the operating conditions of the internal combustion engine.

The throttle element 3, to avoid areas of turbulence, is designed maximally favorably from the viewpoint of fluid dynamics and comprises a spherical segment-shaped throttle element half 16 oriented in oppposition to the flow, which half 16 is connected with a throttle element half 17 facing away from the flow. The throttle element half 16 has a pin 18 disposed in the flow direction, this pin 18 being slidably arranged in a sliding bushing 19 of a rocking lever 20. The rocking lever 20 is connected to a bearing shaft 21 arranged outside of the air flow path at the air intake manifold.

An operating lever 22 likewise engages the bearing shaft 21, which lever 22 is connected to a gas pedal (not shown). A compensating spring 23 is arranged coaxially to the pin 18, this spring 23 being supported, on the one hand, at the rocking lever 20 and, on the other hand, acts on the throttle element half 16 in such a way that the throttle element 3 is moved against the flow direction until a shoulder 24 of the throttle element half 17 comes into contact with the rocking lever 20.

The compensating spring 23 is designed so that during full-load positions of the rocking lever 20 and at lower speeds of the internal combustion engine, the force of the compensating spring 23 is larger than the force of the air effective due to the pressure drop at the throttle element 3 so that the corresponding spring 23 displaces the throttle element 3 on the rocking lever 20 against the flow direction until the shoulder 24 comes into contact with the rocking lever 20. This has the result that a larger pressure drop is produced at the throttle element 3, which can be surrounded by the fuel-air mixture flow on all sides, in case of full load and at lower speeds of the internal combustion engine. This larger pressure drop makes it possible to improve the conditioning of the injected fuel to provide a power increase with a simultaneous reduction of poisonous exhaust gas components. During full load and at higher speeds of the internal combustion engine, the air pressure based on the pressure drop at the throttle element 3 overcomes the bias of the compensating spring 23 and displaces the throttle element 3 on the rocking lever 20 in the opening direction until a full-load stop 25 of the throttle element half 16 comes into contact with the rocking lever 20.

To compensate for the opening moment effective on the bearing shaft 21 due to the air pressure acting on the throttle element 3, the bearing shaft 21 is connected to a compensating lever 27 which, at its end facing away from the bear shaft 21, is coupled with a diaphragm 28 formed as a resilient member. The diaphragm 28 separates a vacuum chamber 29, connected via a line 30 to the air intake manifold section 4 downstream of the throttle element 3, from a chamber 31 wherein atmospheric pressure or the pressure in the air intake manifold section 8 upstream of the throttle element 3 is ambient.

In the chamber 31, a resetting spring 32 is likewise arranged, this spring resting on the diaphragm 28 and acting, via the compensating lever 27, as a resetting force on the throttle element 3. The position of the compensating lever 27 can be limited by a screw 33 in such a way that an idling cross section for the fuel-air mixture is maintained between the throttle element 3 and the wall of the air intake manifold.

We claim:

1. A fuel supply system for mixture-compressing, spark-ignited internal combustion engines having an air intake manifold; an arbitrarily operable throttle element disposed within said intake manifold; a bearing shaft spaced from said throttle element; a rocking lever connected at one end to said bearing shaft outside of the air flow of said air intake manifold; with said throttle element mounted on the opposite end of said rocking lever for movement in the direction of air flow; a compensating spring operative between said throttle element and said rocking lever; said throttle element being mounted on said rocking lever so as to be displaceable in an opening direction against the bias of said compensating spring; means upstream of said throttle element for supplying a fuel-air mixture, said throttle element being mounted on said rocking lever in said intake manifold so that it is surrounded by fuel-air flow during an opening movement in the direction of fuel-air flow and so positioned that said throttle element can be corrected in dependence on pressure drop present at the throttle element against the bias of said compensating spring.

2. A fuel supply system according to claim 1, wherein said throttle element includes a spherical segment-shaped portion facing the direction of fuel-air flow which is favorable from the standpoint of fluid dynamics on its side oriented against the air flow on its side facing away from the air flow.

3. A fuel supply system according to claim 2 or 1, including a resilient member connected to said bearing shaft so as to provide a compensating moment which acts against the opening moment effective due to the pressure drop at said throttle element, a resetting spring, said resilient member being under the action, on the one hand, of said resetting spring and of the air pressure upstream of the throttle element or of the atmospheric pressure, and on the other hand, under the action of the air pressure downstream of said throttle element.

* * * * *